US006371806B1

(12) United States Patent
Ko

(10) Patent No.: US 6,371,806 B1
(45) Date of Patent: Apr. 16, 2002

(54) CABLE END CONNECTOR HAVING ACCURATELY POSITIONED CONNECTION TERMINAL THEREIN

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/709,226

(22) Filed: Nov. 8, 2000

(51) Int. Cl.[7] ..... H01R 17/04
(52) U.S. Cl. ..... 439/585
(58) Field of Search ..... 439/578–585

(56) References Cited

U.S. PATENT DOCUMENTS 5,061,206 A * 10/1991 Kawanami et al. ..... 439/585
5,110,308 A * 5/1992 Nishikawa et al. ..... 439/585
5,263,877 A * 11/1993 Mitani ..... 439/585
5,569,049 A * 10/1996 Tatebe et al. ..... 439/585
5,603,636 A * 2/1997 Kanou et al. ..... 439/585
5,785,555 A * 7/1998 O'Sullivan et al. ..... 439/585
5,860,833 A * 1/1999 Chillscyzn et al. ..... 439/585

* cited by examiner

*Primary Examiner*—Gary F. Paumen
(74) *Attorney, Agent, or Firm*—Wei Te Chung

(57) ABSTRACT

A cable end connector includes a dielectric housing, a terminal received in the housing, a shell shielding the housing, and a retainer attached to the shell for holding a coaxial cable therein. The housing includes a tubular portion defining a passageway therethrough, and a base portion engaged with the tubular portion. The terminal has a mating portion held in the passageway for mating with a complementary connector, and a tail portion supported on the base portion for connecting with an inner conductor of the coaxial cable. The shell has a trunk portion enclosing the tubular portion of the housing, and a planar portion connected to the base portion and supporting the housing. A pair of arms rearwardly extend from the trunk portion for accommodating the tail portion of the terminal therebetween. The retainer has a braiding crimp for grounding a braiding layer of the coaxial cable.

1 Claim, 7 Drawing Sheets

CABLE END CONNECTOR HAVING ACCURATELY POSITIONED CONNECTION TERMINAL THEREIN

FIELD OF THE INVENTION

The present invention relates to a cable end connector, and more particularly to a cable end connector accurately positioning a terminal therein and reliably mating with a complementary connector.

BACKGROUND OF THE INVENTION

Cable end connectors are often used for transmitting Radio-frequency (RF) signals. The cable end connectors normally have a terminal received in a housing thereof to mate with a complementary plug. Such a conventional cable end connector is, for example, disclosed in U.S. Pat. No. 5,263,877. The cable end connector includes a dielectric member holding a central terminal within an outer conductive shell. The central terminal has a U-shaped connection portion for connecting with a coaxial cable and a coupling portion for mating with a complementary plug. As disclosed in this patent, in assembly, an upper side wall of the dielectric member and a holder portion of the outer shell are bent substantially at a right-angle to hold the connection portion of the terminal and an inner conductor of the coaxial cable within the dielectric member and to crimp the coaxial cable braiding to the connector outer shell.

However, the terminal is connected to the coaxial cable before assembly to the housing, thus it cannot be precisely positioned. Any misalignment between the coaxial cable and the housing will adversely affect proper positioning of the terminal.

Hence, an improved connector for accurately and firmly positioning a terminal is required to overcome the disadvantages of the prior art.

BRIEF SUMMARY OF THE INVENTION

A main object of the present invention is to provide a cable end connector accurately positioning a terminal and reliably mating with a complementary connector.

Another object of the present invention is to provide a cable end connector having a retainer which reliably secures a coaxial cable therein.

A further object of the present invention is to provide a method for facilitating assembly of a cable end connector and for firmly connecting a coaxial cable therewith.

A cable end connector according to the present invention comprises a dielectric housing, a terminal received in the housing, a unitarily formed shell, and a retainer attached to the shell for holding a coaxial cable therein.

The housing includes a base portion and a tubular portion engaged with the base portion. The tubular portion axially defines a passageway therethrough. The terminal has a mating portion and a tail portion perpendicular to each other. The mating portion extends into the passageway for mating with a complementary connector. The tail portion is retained on the base portion for connecting with an inner conductor of the coaxial cable. The shell comprises a planar portion supporting the housing, and a trunk portion bendably connected to the planar portion and enclosing the tubular portion of the housing. A pair of arms rearwardly extend from the trunk portion. The arms and a portion of the retainer define a space for accommodating the tail portion of the terminal. The retainer has a braiding crimp at an end thereof extending rearwardly beyond the arms of the trunk portion for grounding a braiding layer of the coaxial cable.

Other objects, advantages and novel features of the invention will become more apparent from the following detailed description when taken in conjunction with the accompanying drawings.

DETAILED DESCRIPTION OF THE INVENTION

Figure 5:
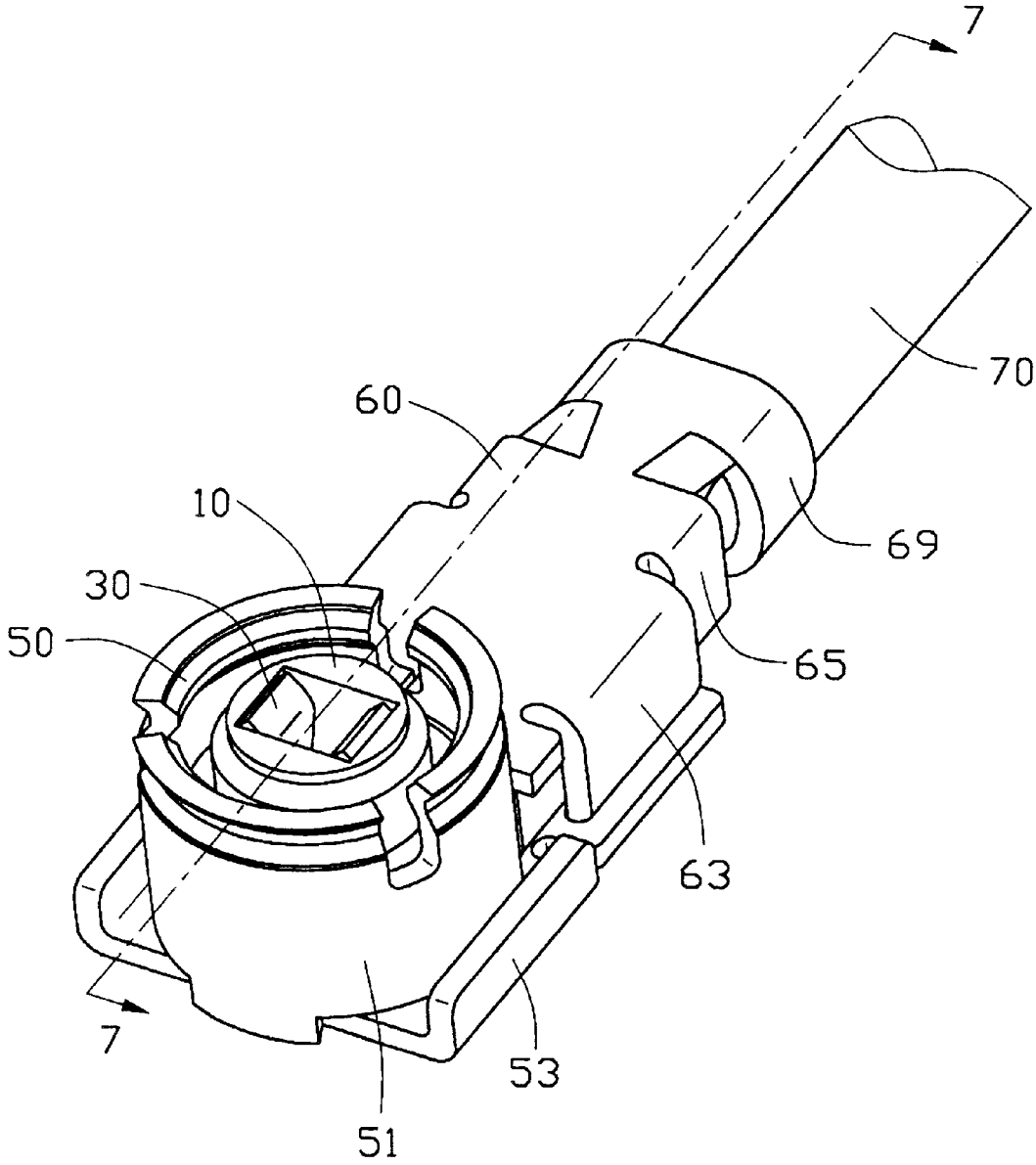
FIG. 5 is a perspective view of a cable end connector assembly of the present invention.
Figure 6:
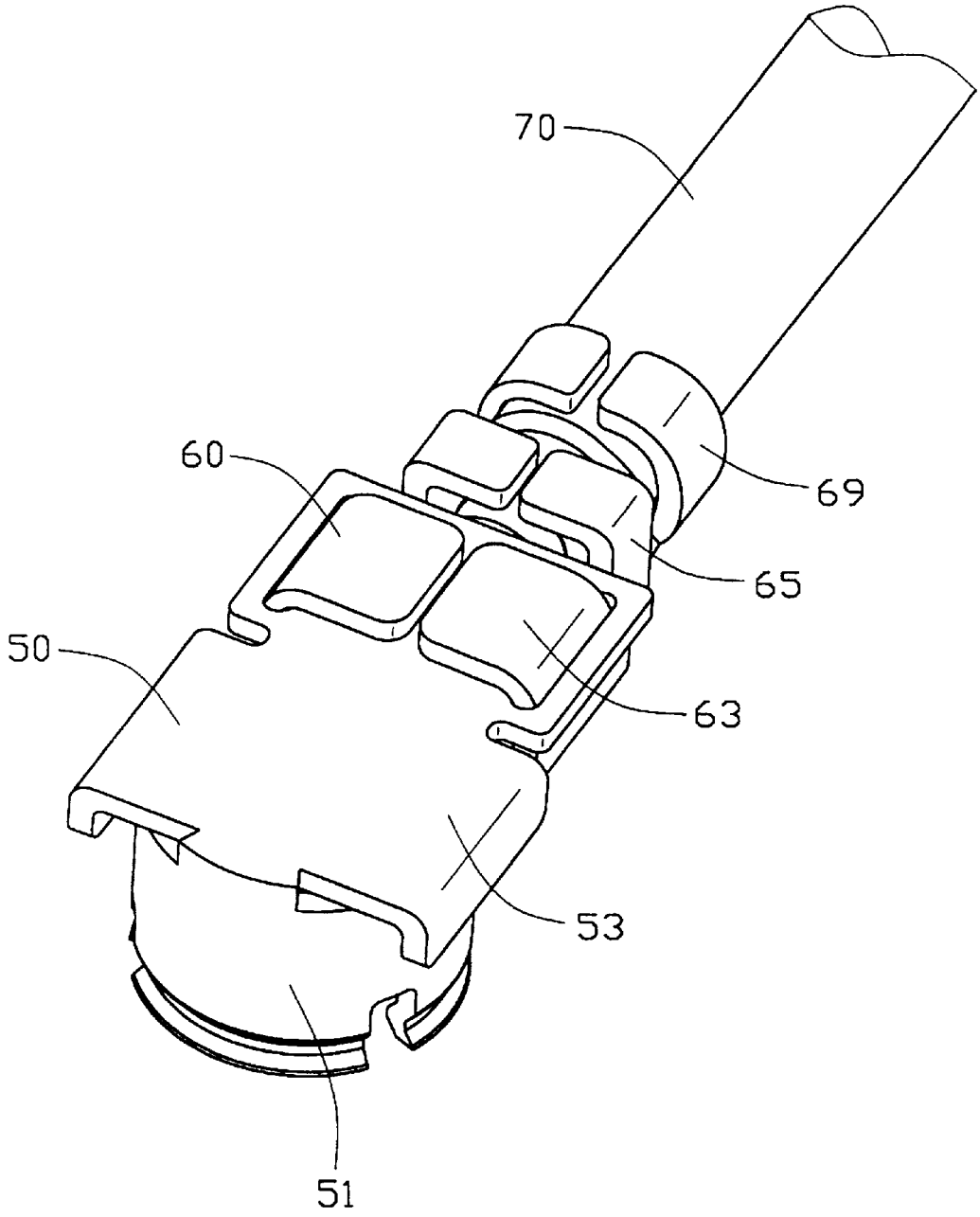
FIG. 6 is a view similar to FIG. 5 but from another perspective.
Figure 7:
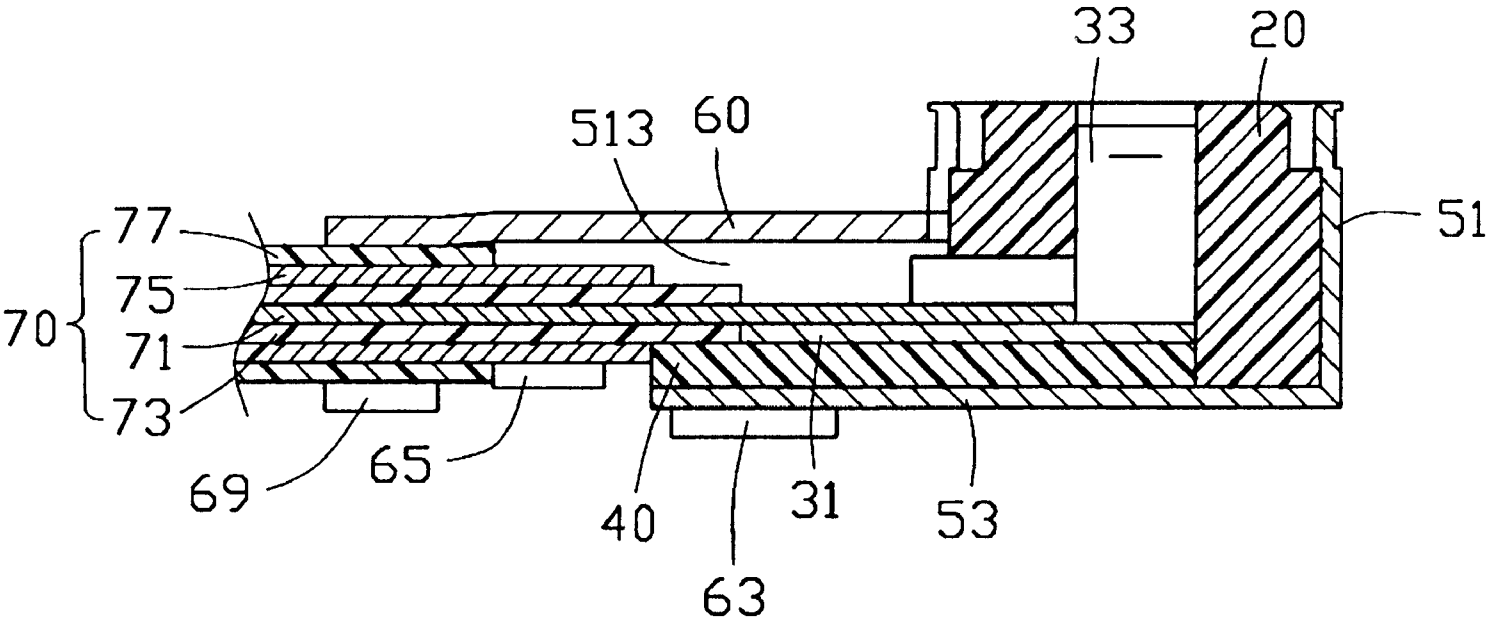
FIG. 7 is a cross-sectional view taken along line 7-7 of FIG. 5.

Referring to the drawings and particularly to FIGS. 5 and 6, a cable end connector in accordance with the present invention comprises a dielectric housing 10, a terminal 30, a metallic shell 50 shielding the housing 10 and the terminal 30, and a retainer 60 for securing an end portion of a coaxial cable 70 (see FIG. 7).

Figure 1:
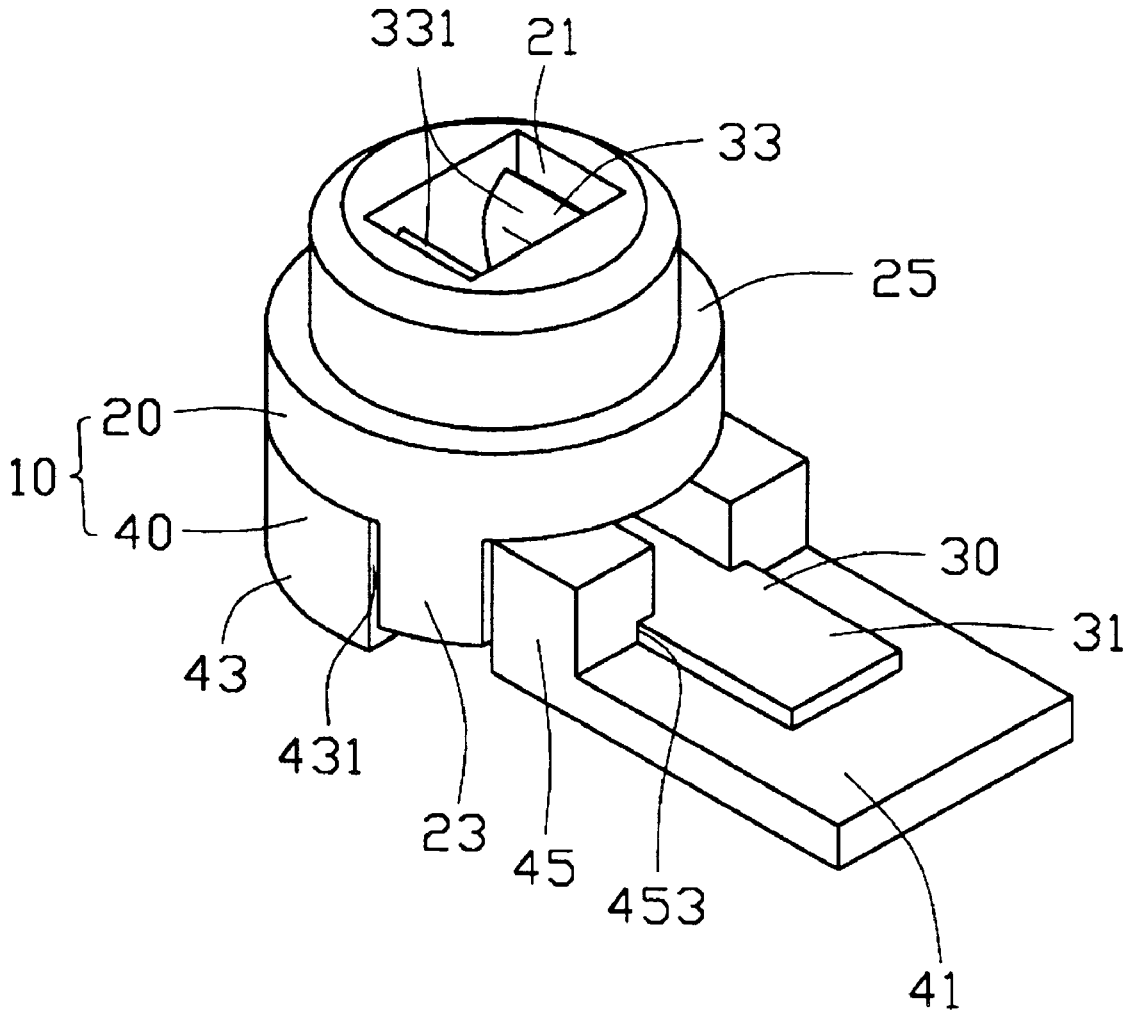
FIG. 1 is a perspective view of a terminal assembled within a housing of a cable end connector according to the present invention.

Referring to FIG. 1, the dielectric housing 10 comprises a vertical tubular portion 20 and a base portion 40 for engaging with the tubular portion 20. A substantially rectangular passageway 21 is axially defined through the tubular portion 20. Preferably, the tubular portion 20 forms a step 25 around an outer periphery thereof for supporting the shell 50. Three mounting legs 23 equiangularly depend from the bottom of the tubular portion 20 for locking with the base portion 40. The base portion 40 comprises a cylindrical engaging block 43 and a flat portion 41 extending rearwardly from the engaging block 43. A pair of retaining walls 45 project along the opposite sides of the flat portion 41. A pair of grooves 453 are respectively defined in an inward lower corner of each retaining wall 45 opposing each other. Three recesses 431 are equiangularly distributed in an outer periphery of the engaging block 43 and dimensioned for retaining the mounting legs 23.

The terminal 30 is L-shaped and includes a mating portion 33 aid a planar tail portion 31 perpendicular to each other. The mating portion 33 is bifurcated and consists of a pair of beams 331 substantially projecting toward each other for mating with a complementary connector (not shown).

Figure 2:
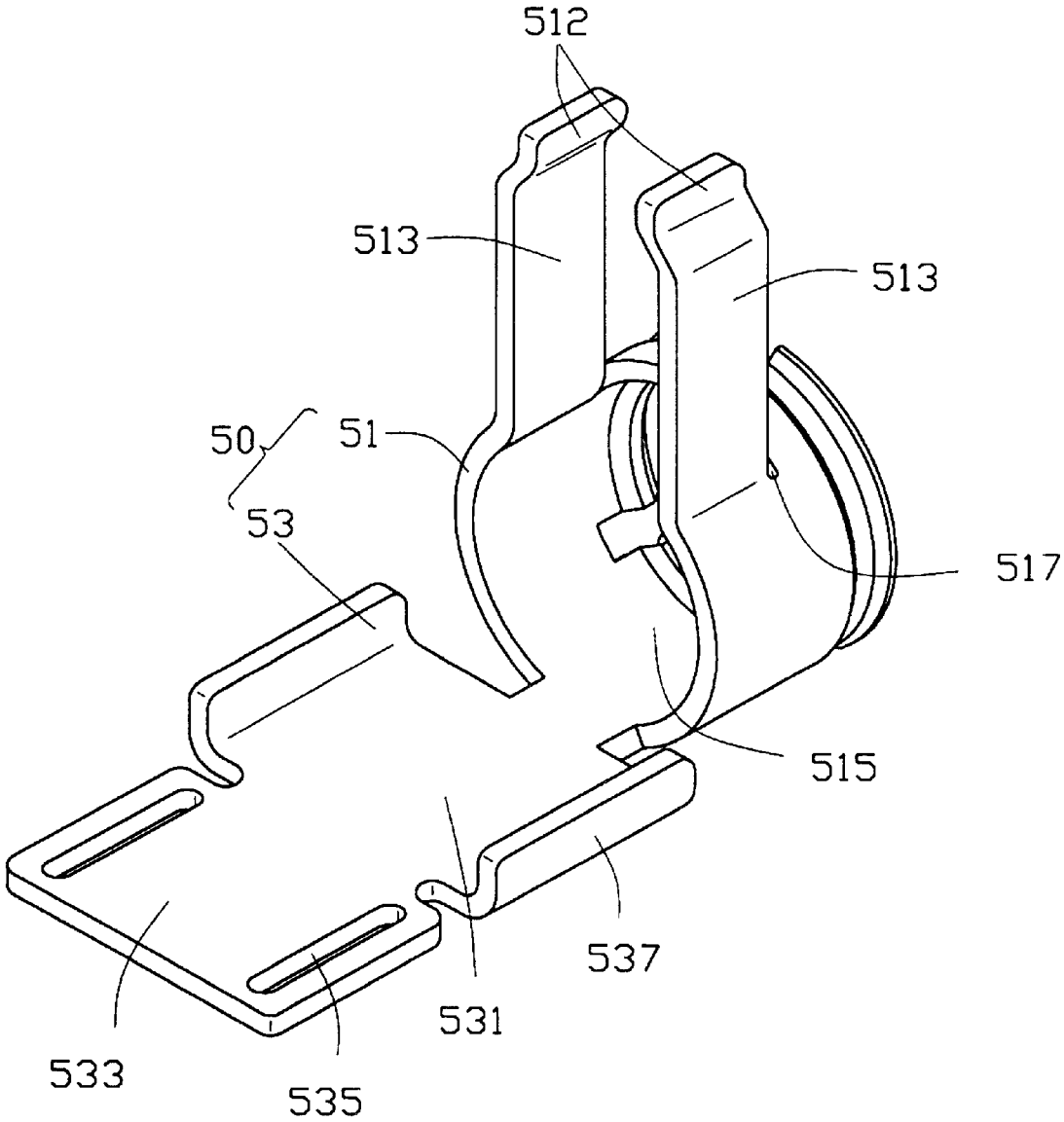
FIG. 2 is a perspective view of a shell of the cable end connector, showing a trunk portion in a state before it is bent toward a planar portion thereof.
Figure 3:
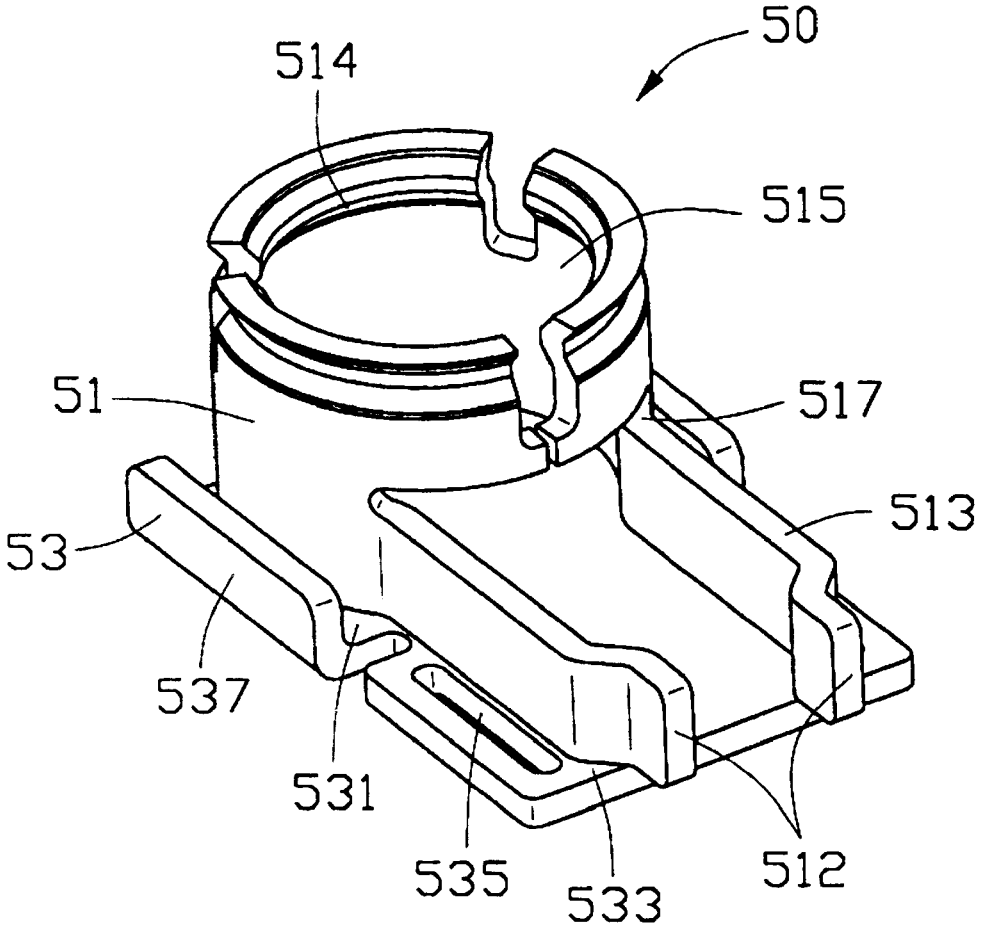
FIG. 3 is a view similar to FIG. 2 but showing that the trunk portion is bent to be assembled on the planar portion.

The shell 50 is unitarily formed and comprises a cylindrical trunk portion 51 and a planar portion 53 connected to the trunk portion 51. FIG. 2 shows the shell 50 when the trunk portion 51 is unbent and is approximately perpendicular to the planar portion 53, while FIG. 3 shows the shell 50 when the trunk portion 51 is bent toward and supported on the planar portion 53.

The trunk portion 51 is substantially cylindrical and has a pair of arms 513 rearwardly extending from a lower portion thereof. Each arm 513 has a distal end 512 protruding inwardly. The trunk portion 51 defines a hollow portion 515 therethrough for enclosing the tubular portion 20 of the housing 10. Preferably, a step 514 is formed on an inner periphery of the trunk portion 51 for cooperating with the step 25 of the housing 10. A notch 517 is defined above the arms 513.

The planar portion 53 has a front portion 531 for supporting the trunk portion 51, and a rear portion 533 rearwardly extending from the front portion 531 for supporting the arms 513 and the housing 10. The front portion 531 forms a pair of side walls 537 on opposite sides thereof for interferentially fitting with the outer periphery of the trunk portion 51. A pair of elongated and narrow slots 535 are respectively defined adjacent opposite sides of the rear portion 533.

Figure 4:
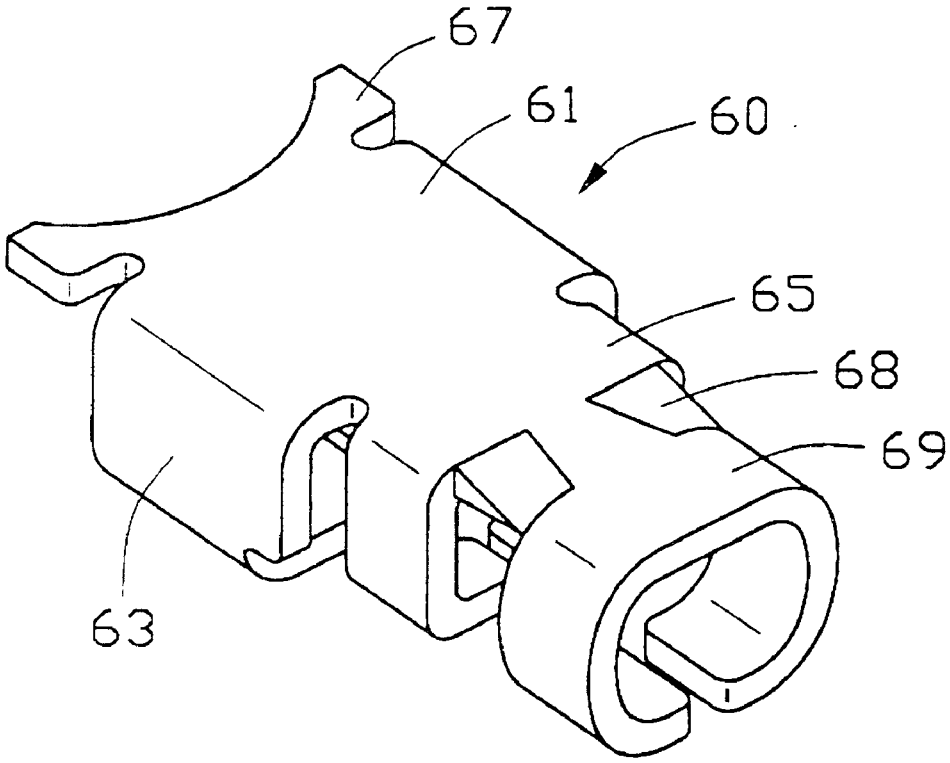
FIG. 4 is a perspective view of a retainer of the cable end connector in a bended, crimping state.

With reference to FIG. 4, the retainer 60 is conductive and comprises a planar top wall 61, a braiding crimp 65 rearwardly extending from an edge of the top wall 61 for grounding a braiding layer 75 of the coaxial cable 70 (see FIG. 7), and a strain relief 69 rearwardly extending from the braiding crimp 65 for securely clamping the coaxial cable 70. A connection strip 67 forwardly extends from a forward edge of the top wall 61 for locking with the notch 517 of the trunk portion 51. A pair of locking tabs 63 respectively depend downward from opposite sides of the top wall 61 for engaging with the slots 535 of the planar portion 53. A pair of triangular ribs 68 are formed between the strain relief 69 and the braiding crimp 65 for enhancing the strength of the strain relief 69. FIG. 4 shows the retainer 60 in its bended, crimping state. Prior to assembly, it is in an unbended state in which the top wall 61 and locking tabs 63, the braiding crimp 65, and the strain relief 69 all have generally U-shaped cross-sections.

Particularly referring to FIG. 7, the coaxial cable 70 includes an inner conductor 71, a braiding layer 75, an inner insulator 73 separating the inner conductor 71 and the braiding layer 75 and an outer insulator 77 surrounding the braiding layer 75.

Referring to FIGS. 5–7, a cable end connector assembly is assembled as follows.

(1) The tail portion 31 of the terminal 30 is inserted from the engaging block 43 of the base portion 40 of the housing 10, through the grooves 453, and extends rearwardly beyond the retaining walls 45. The tail portion 31 of the terminal 30 is then secured in the grooves 453 of the retaining walls 45.

(2) The tubular portion 20 of the housing 10 is mounted onto the base portion 40. The mating portion 33 of the terminal 30 extends into the passageway 21 of the tubular portion 20, the beams 331 of the mating portion 33 abutting against corresponding inner walls (not labeled) of the passageway 21.

(3) An inner conductor 71 of the coaxial cable 70 is soldered onto the tail portion 31 of the terminal 30.

(4) The trunk portion 51 of the shell 50 is brought to encircle the housing 10. The arms 513 accommodate the flat portion 41 of the housing 10 therebetween.

(5) The planar portion 53 is bent toward the trunk portion 51 until the planar portion 53 completely abuts a bottom of the housing 10.

(6) The connection strip 67 of the retainer 60 is snapped into the notch 517 of the trunk portion 51. The locking tabs 63 of the retainer 60 engage with the corresponding slots 535 of the planar portion 53, thereby fixedly retaining the arms 513 to an upper face of the planar portion 53. The tail portion 31 of the terminal 30 is therefore surrounded by both the arms 513 and the top wall 61 of the retainer 60 but without contacting either. The braiding crimp 65 of the retainer extends beyond the arms 513 of the trunk portion 51 for securely clamping the braiding layer 75 of the coaxial cable 70. The outer insulator 77 of the coaxial cable 70 is firmly retained in the strain relief 69 of the retainer 60.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector comprising:

a housing including a base portion and a tubular portion engaged with said base portion, the tubular portion defining a passageway defined therein;

a terminal received in said passageway and having a tail portion supported on said base portion;

a shell including a planar portion attached to a bottom face of said base portion, and a trunk portion connected to said planar portion and enclosing said tubular portion of said housing, said trunk portion including a pair of arms extending beside said base portion of said housing; and a retainer attached to said planar portion for retaining said arms to said planar portion, said retainer and said arms surrounding but not contacting said tail portion of said terminal;

wherein the base portion of the housing comprises an engaging block, a flat portion extending rearwardly from the engaging block, and a pair of retaining walls projecting along two opposite sides of the flat portion;

wherein a pair of grooves are respectively defined in an inward lower corner of each retaining wall for securely fixing the tail portion of the terminal therein;

wherein at least one mounting leg depends downwardly from the tubular portion, and wherein at least one recess is defined in the base portion of the housing and dimensioned for engaging with the at least one mounting leg;

wherein the terminal comprises a bifurcated mating portion consisting of a pair of beams substantially projecting toward each other for mating with a complementary connector;

wherein the planar portion of the shell has a front portion for supporting said trunk portion, and a rear portion rearwardly extending from the front portion for supporting both the arms of the shell and the base portion of the housing;

wherein a pair of side walls are respectively formed on opposite sides of said front portion for interferentially fitting with an outer periphery of the trunk portion;

wherein each arm of the trunk portion comprises an inwardly protruding distal end;

wherein the retainer further includes a braiding crimp for grounding a braiding layer of a coaxial cable, and a strain relief for securely clamping the coaxial cable;

wherein a pair of locking tabs respectively depends downwardly from opposite sides of the retainer, and wherein a pair of elongated slots are respectively defined in the planar portion for engaging with the locking tabs;

wherein the retainer further includes a connection strip forwardly extending from a forward edge thereof, and wherein a notch is defined above the arms of the trunk portion for receiving the connection strip.

* * * * *